US008230696B2

(12) United States Patent
Yamaguchi et al.

(10) Patent No.: US 8,230,696 B2
(45) Date of Patent: Jul. 31, 2012

(54) DEVICE EQUIPPED WITH COOLING MECHANISM

(75) Inventors: Hiroki Yamaguchi, Toyoake (JP); Masaaki Kawasumi, Toyoake (JP); Seiji Kobayashi, Toyoake (JP); Tomoyuki Sanada, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 858 days.

(21) Appl. No.: 12/227,323

(22) PCT Filed: Sep. 26, 2006

(86) PCT No.: PCT/JP2006/319076

§ 371 (c)(1),
(2), (4) Date: Nov. 14, 2008

(87) PCT Pub. No.: WO2008/038341

PCT Pub. Date: Apr. 3, 2008

(65) Prior Publication Data

US 2009/0126383 A1 May 21, 2009

(51) Int. Cl.
*F25D 19/00* (2006.01)

(52) U.S. Cl. ..... 62/449

(58) Field of Classification Search ..... 62/259.1, 62/449

See application file for complete search history.

(56) References Cited

U.S. PATENT DOCUMENTS 6,096,177 A * 8/2000 Kamitani et al. ..... 204/241

FOREIGN PATENT DOCUMENTS

| | | |
|---|---|---|
| JP | H2-38017 | 3/1990 |
| JP | 2000-304413 | 11/2000 |
| JP | 2000-304414 | 11/2000 |
| JP | 2002-243347 | 8/2002 |
| JP | 2006-156096 | 6/2005 |
| JP | 2006-105433 | 4/2006 |
| JP | 2006-153336 | 6/2006 |

* cited by examiner

*Primary Examiner* — Melvin Jones
(74) *Attorney, Agent, or Firm* — DLA Piper LLP (US)

(57) ABSTRACT

To prevent incorrect operation of an operating member provided in an electric component box without giving complicated processing on a front panel. An opening formed in the front portion of a housing (11) to correspond to a machine room (14) is closed with a front panel (20). A suction louver (25) and a delivery louver (26) are formed in the front panel (20). An inserting/withdrawing opening (28) used for inserting/withdrawing a filter (34) is opened above the position for forming the suction louver (25) in the front panel (20). A base portion (38) being fitted in the inserting/withdrawing opening (28) to close the opening (28) is formed above the filter (34). A power switch (43) and a service switch (44) are provided on the front of the electric component box (42) arranged in the machine room (14). The portion for arranging the power switch (43) and the service switch (44) in the electric component box (42) opposes the rear of the inserting/withdrawing opening (28). When the filter (34) is fixed to the front panel (20), the front side of the power switch (43) and the service switch (44) is covered with the base portion (38).

4 Claims, 8 Drawing Sheets

DEVICE EQUIPPED WITH COOLING MECHANISM

TECHNICAL FIELD

The present invention relates to a device equipped with a cooling mechanism in which a cooling mechanism and an electric component box for accommodating various electric components which control the cooling mechanism are disposed in a machine room defined inside a housing.

BACKGROUND ART

In an ice making machine, a refrigerator or the like, an ice making section or a cooling mechanism for cooling the interior of the refrigerator is disposed in a machine room defined inside a housing. The cooling mechanism basically includes a compressor, a condenser, a capillary tube, and an evaporator, and the condenser in use is of an air cooling type which executes compulsive cooling with a cooling fan disposed in the machine room to perform heat exchange with a coolant.

The structure that relates to the heat exchange of the air cooling type condenser will be described briefly. A large opening is formed in the front portion of the housing which is the main body of the ice making machine, refrigerator or the like at a position corresponding to the machine room defined inside, and is sealed in such a way as to be opened and closed by a front panel. The front panel has an air inlet port and an air discharge port provided therein, so that outside air sucked through the air inlet port by rotating the cooling fan disposed in the machine room contacts the condenser for heat exchange, and is then discharged outside through the air discharge port. In this case, various kinds of dust are sucked through the air inlet port along with the air, and a part of the dust adheres to and is deposited on the outer surface of the condenser with elapse of time. This results in a reduction in the heat exchange efficiency in the condenser, which may lead to overheating or the like thereof to cause malfunction thereof.

In this respect, a structure is employed which adapts the front panel in such a way that a filter for collecting dust is detachably mounted to the front panel at a position corresponding to the air inlet port, and removes dust contained in air with a filter mounted to the front panel before the dust contacts the condenser (see, for example, Patent Document 1).

In the cooling mechanism equipped-device, an electric component box accommodating various electric components which control the cooling mechanism is disposed in the machine room (see, for example, Patent Document 2). In the device described in Patent Document 2, a display section which displays the temperature in the refrigerator and an operation panel or the like for inputting a set temperature are provided at the front surface of the electric component box, and the front surface of the electric component box is structured in such a way that the operation panel or the like faces a window portion opened in the front panel to be easily operated.

Patent Document 1: Japanese Patent Application Laid-Open No. 2000-304414

Patent Document 2: Japanese Patent Application Laid-Open No. 2005-156096

DISCLOSURE OF INVENTION

Problem to be Solved by the Invention

Operational members which are not operated during normal operation, such as a main power switch and a switch for effecting services like repair and maintenance, are also disposed in the electric component box. With the structure where the front surface of the electric component box is exposed as in the Patent Document 2, a worker who is doing another work in front of the device or an object may contact the operational members, so that the operational members are operated accidentally. To prevent an unintentional operation, it is therefore necessary to provide an open/close door to close the window portion opened in the front panel in an openable/closable manner so that the front surface of the electric component box is covered normally. That is, in addition to the work of mounting the filter in the aforementioned manner, the front panel should be worked to provide the open/close door, thus complicating the structure of the panel and increasing the number of working processes. This brings about the problem of increasing the manufacturing cost.

Accordingly, the present invention has been proposed to solve the inherent problem of the cooling mechanism equipped-device according to the related art, and it is an object of the invention to provide a device equipped with a cooling mechanism which can prevent an erroneous operation of operational members provided in an electric component box without making complex working to the front panel.

Means for Solving the Problem

To overcome the problem and achieve the desired object, a device equipped with a cooling mechanism as set forth in claim 1, wherein the cooling mechanism includes a condenser or the like disposed in a machine room defined inside a housing, and a suction part provided at a front panel sealing an opening formed in a front portion of the housing which corresponds to the machine room, so that outside air sucked into the machine room through the suction part contacts the condenser for heat exchange, characterized in that an electric component box accommodating an electric part for controlling the cooling mechanism is disposed in the machine room in such a way that an operational member provided at a front surface of the electric component box faces a rear side of an inserting/withdrawing opening formed in the front panel at a portion upper than a forming location of the suction part and penetrating in a to-and-fro direction, and a base portion closing the inserting/withdrawing opening to cover a front side of the operational member, is provided at a filter insertable in and withdrawable from the inserting/withdrawing opening and covering a rear side of the suction part when inserted in the front panel rearward from a front side thereof.

According to the subject matter of claim 1, an erroneous operation of the operational member can be prevented as the front side of the operational member in the electric component box which faces the rear side of the inserting/withdrawing opening for mounting the filter to the front panel is covered with the base portion of the filter mounted to the front panel. That is, it is unnecessary to provide an opening or an open/close door for operating the operational member, thus making it possible to simplify the structure of the panel and to lower the manufacturing cost.

The gist of the subject matter of claim 2 is that an eaves extending frontward is provided at the front side of the electric component box in a predetermined length in a widthwise direction and above the operational member, and an upper surface of the eaves is inclined upward in a frontward direction of the upper surface.

According to the subject matter of claim 2, dew condensation or the like falling down to the front surface of the electric component box can be inhibited from reaching the portion of layout of the operational member with the eaves, thus preventing moisture from entering the box from the layout portion and causing corrosion of electric components, electric leakage or the like.

The gist of the subject matter of claim 3 is that a recess having substantially a same width as that of the inserting/withdrawing opening, recessed rearward, and open upward, downward and frontward is provided at a front portion of an upper wall of the front panel.

According to the subject matter of claim 3, as the recess is formed on the front side of the upper portion of the inserting/withdrawing opening, the filter can be easily inserted into the inserting/withdrawing opening from obliquely above, and pulled out obliquely upward therefrom.

The gist of the subject matter of claim 4 is that the filter is formed in an arcuate shape with a front side being an inner peripheral side, and a preventing piece protruding in such a way as to be inclined frontward in an upward direction from a lower end of the front side of the filter is provided at the lower end of the front side of the filter.

According to the subject matter of claim 4, at the time the filter is inserted through the inserting/withdrawing opening, the preventing piece can prevent the lower end of the filter from being hooked, thus achieving smooth insertion.

Advantage of the Invention

The device equipped with a cooling mechanism according to the present invention can prevent an erroneous operation of the operational member provided in the electric component box without making complex working to the front panel.

DESCRIPTION OF REFERENCE NUMERALS

Figure 1:
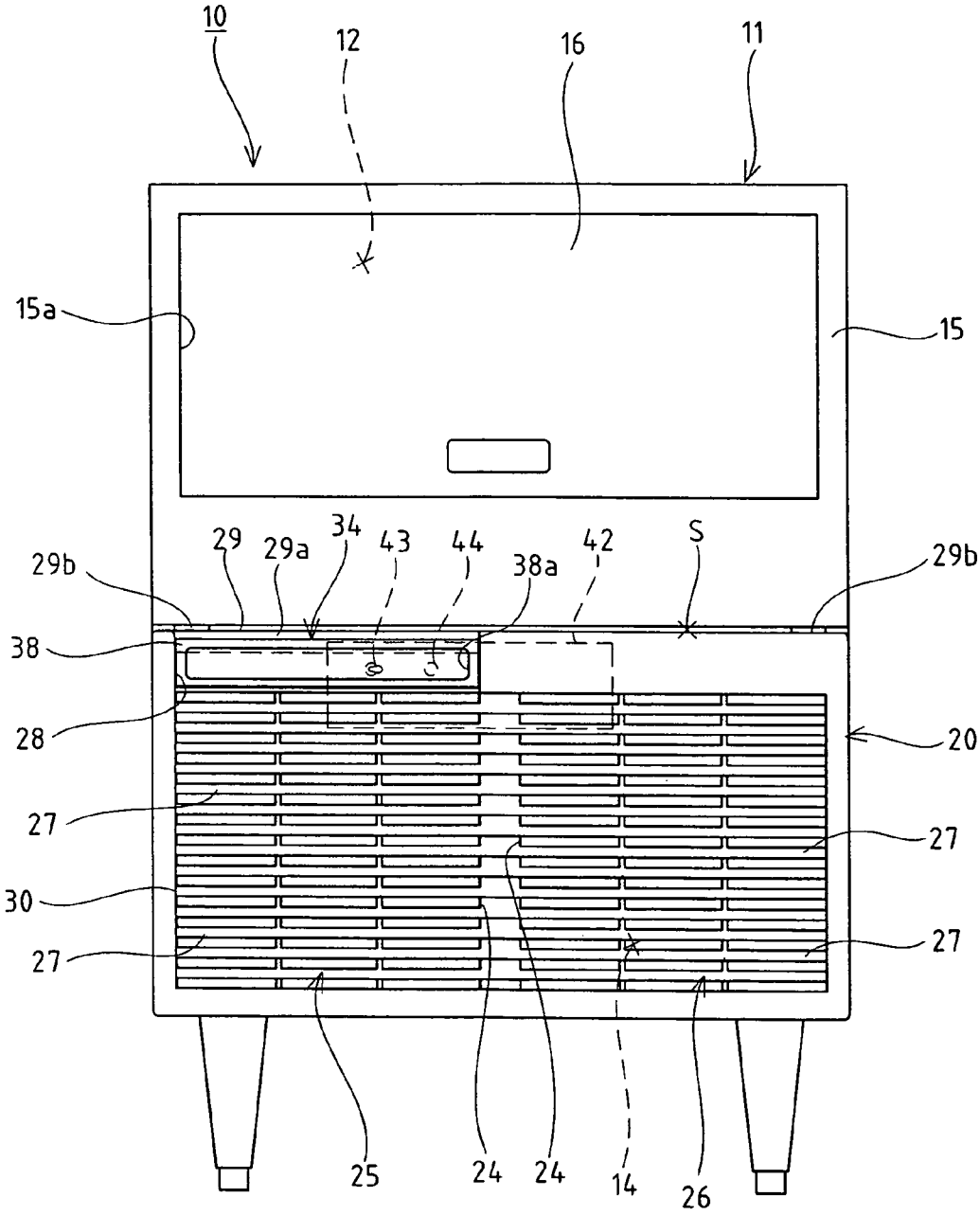
FIG. 1 is a front view of an ice making machine according to an embodiment.

11 housing 11
11*a* opening
13 cooling mechanism
14 machine room
17 condenser
20 front panel
25 suction louver (suction part)
28 inserting/withdrawing opening
29 upper wall
29*a* recess
34 filter
38 base portion
41 preventing piece
42 electric component box
43 power switch (operational member)
44 service switch (operational member)
45 eaves
45*a* upper inclined surface (upper surface)

BEST MODE FOR CARRYING OUT THE INVENTION

Next, a device equipped with a cooling mechanism according to the present invention will be described below by way of a preferred embodiment with reference to the accompanying drawings. Although the description of the embodiment will be given of an ice making machine as an example of a device equipped with a cooling mechanism, it is not limited to an ice making machine, and can be any devices equipped with a cooling mechanism, such as a refrigerator or a freezer. The terms "front", "rear", "left", and "right" are used herein when viewing an ice making machine from the front side as shown in FIG. 1 unless otherwise specified.

Embodiment

As shown in FIG. 1, an ice making machine 10 according to an embodiment has a housing 11 that is the main body thereof in which an ice storage bin 12 for storing ice cubes produced by an ice making machine (now shown), and a machine room 14 accommodating a cooling mechanism 13 are defined one above the another. A front cover member 15 having a rectangular opening 15*a* formed therein, which corresponds to an opening formed in the housing 11, is provided at the front surface of the housing 11 corresponding to the ice storage bin 12 positioned above, so that ice cubes can be taken out through the opening 15*a*. The housing 11 is provided with a door 16 which can open and close the opening 15*a* of the front cover member 15. Note that the front cover member 15 is formed in a rectangular box-shape open to the rear side, as shown in FIG. 3, with a pair of engagement holes 15*c*, 15*c* being formed in a bottom plate 15*b* penetrating vertically and apart from each other in the widthwise direction (right and left direction in the diagram).

Figure 3:
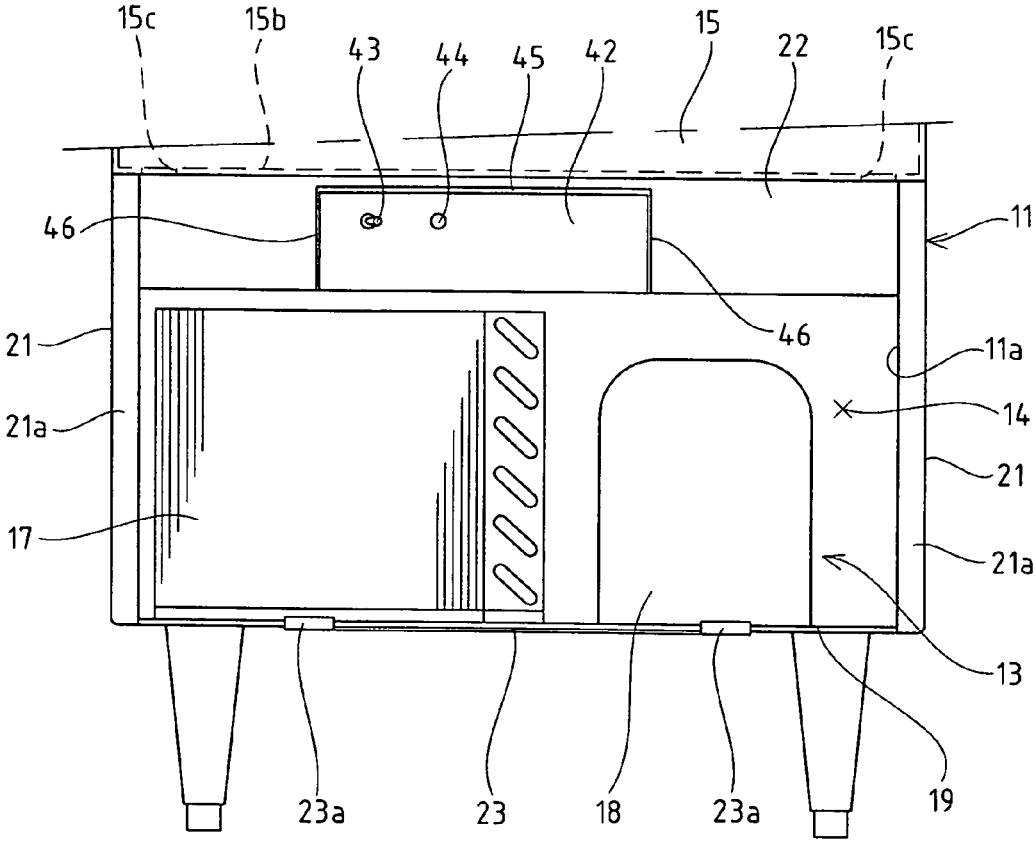
FIG. 3 is a front view of essential portions showing the ice making machine according to the embodiment with the front panel dismounted from a housing.

As shown in FIG. 3, an air cooling type condenser 17 constituting the cooling mechanism 13, a cooling fan (not shown) and a compressor 18 are arranged in the machine room 14 defined on the lower side of the housing 11 on a base plate 19 forming the bottom portion of the machine room 14 in the order from the left side to the right side. A rectangular opening 11*a* open frontward is formed in the front portion of the housing 11 which corresponds to the machine room 14, and is structured to be sealed by a front panel 20 as a louver-equipped panel in an openable/closable manner. Formed at those front portions of left and right side plates 21, 21 constituting the housing 11 which correspond to the machine room 14 is a front side portion 21*a* bent inward (toward the other side plate) at right angles, as shown in FIG. 3. A front plate 22 constituting the housing 11 is disposed so as to extend downward from the bottom plate 15*b* of the front cover member 15 by a predetermined length (see FIGS. 3 and 4). As shown in FIG. 3, the front plate 22, both of the front side portion 21*a* and the base plate 19 define the opening 11*a*. As shown in FIG. 3 or FIG. 5, a support plate 23 extending frontward by a predetermined length is disposed on the base plate 19, and a pair of engagement pieces 23*a*, 23*a* are formed on the support plate 23, bent upward and apart from each other in the widthwise direction.

Figure 6:
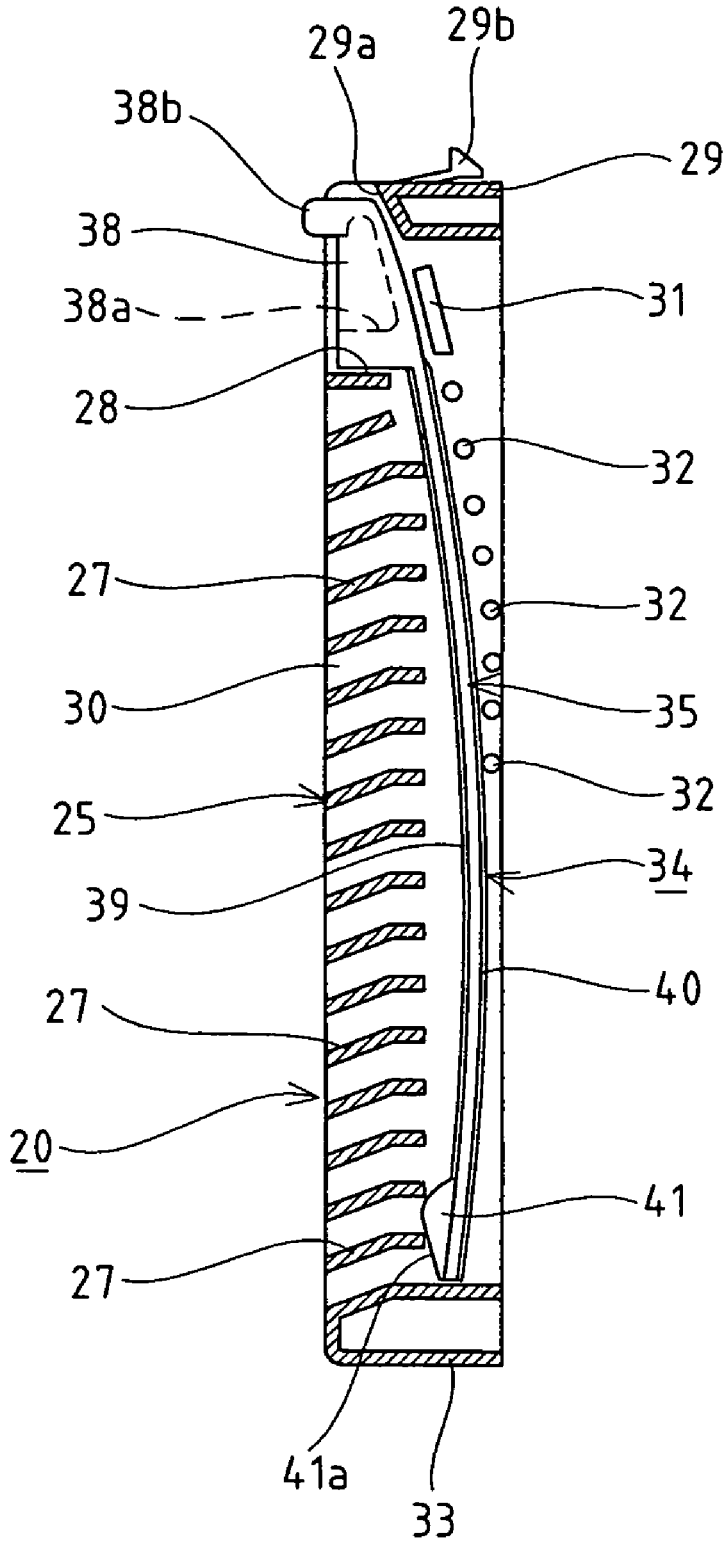
FIG. 6 is a side cross-sectional view showing the front panel according to the embodiment with the filter mounted thereto.
Figure 7:
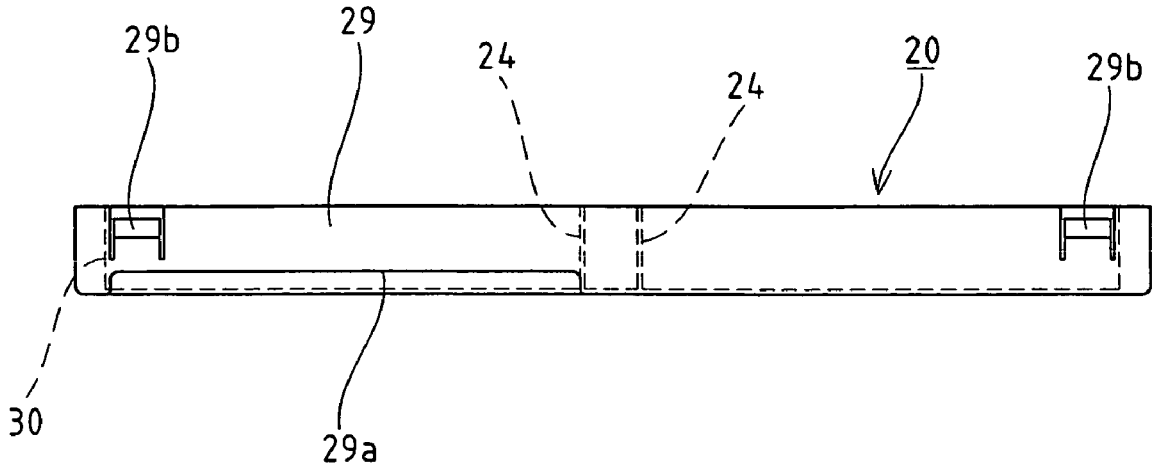
FIG. 7 is a plan view of the front panel according to the embodiment.

The front panel 20 is formed in a rectangular box shape open rearward, and has an outside diameter set to the size which can cover the opening 11*a* of the housing 11. As shown in FIG. 7, a pair of partitions 24, 24 are formed over the entire length of the front panel 20 in the up and down direction at left and right positions apart from each other with approximately the center of the widthwise direction being in between. Suction louvers 25 serving as an air suction part are formed at the front surface portion of the front panel 20 positioned to the left of the left partition 24, and discharge louvers 26 serving as an air discharge part are formed at the front surface portion of the front panel 20 positioned to the right of the right partition 24 (see FIGS. 1 and 2). As shown in FIG. 1 or FIG. 6, the suction louvers 25 and the discharge louvers 26 are a plurality of suction ports or discharge ports, that are defined by providing a plurality of slats 27 extending in the widthwise direction and apart from each other in the up and down direction, each slat 27 being inclined upward from the front side toward the rear side.

Figure 2:
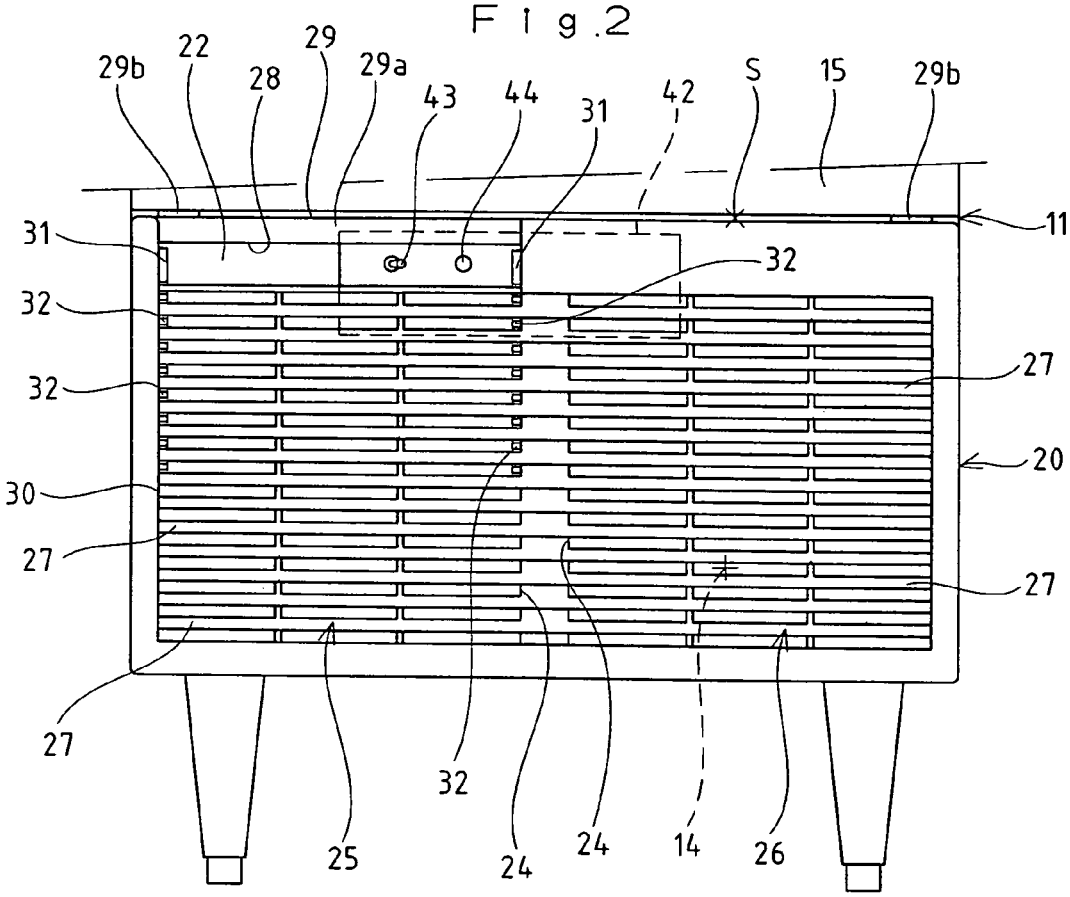
FIG. 2 is a front view of essential portions showing the ice making machine according to the embodiment with a filter dismounted from a front panel.

As shown in FIG. 2, an inserting/withdrawing opening 28, which has the same width size as that of the suction louver 25, is formed in the left front surface portion of the front panel 20 at a position upper than the forming position of the suction louver 25 and penetrating in the forward and backward direction, and a filter 34 to be described later is mounted to the rear side of the front panel 20 via the inserting/withdrawing opening 28 from the front side in a mountable/dismountable manner. As shown in FIGS. 6 and 7, a recess 29*a* having the same width as that of the inserting/withdrawing opening 28 and recessed rearward is formed at the front portion of the upper wall 29 of the front panel 20 in correspondence to the forming position of the inserting/withdrawing opening 28. The recess 29*a* is open upward, downward and sideward to communicate with the inserting/withdrawing opening 28. At the time the front panel 20 is disposed at the housing 11, the inserting/withdrawing opening 28 is positioned so as to face the front side of the front plate 22.

Figure 4:
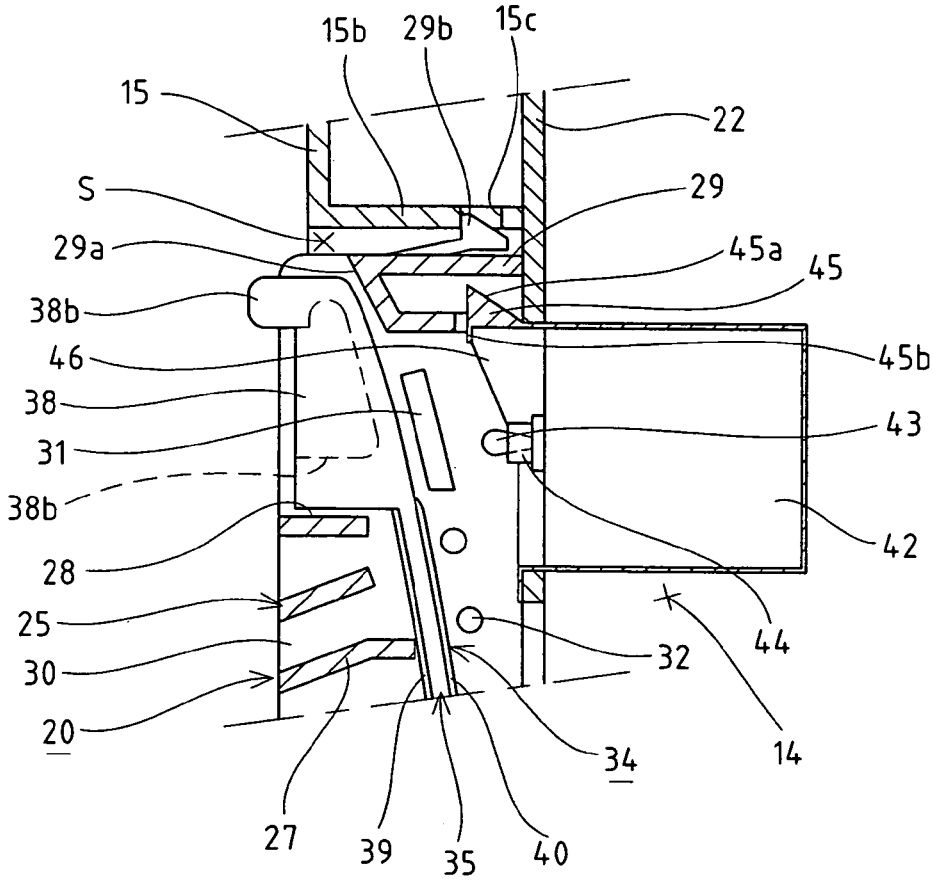
FIG. 4 is a side cross-sectional view of essential portions showing the relationship between the front panel and filter, and an electric component box according to the embodiment.
Figure 5:
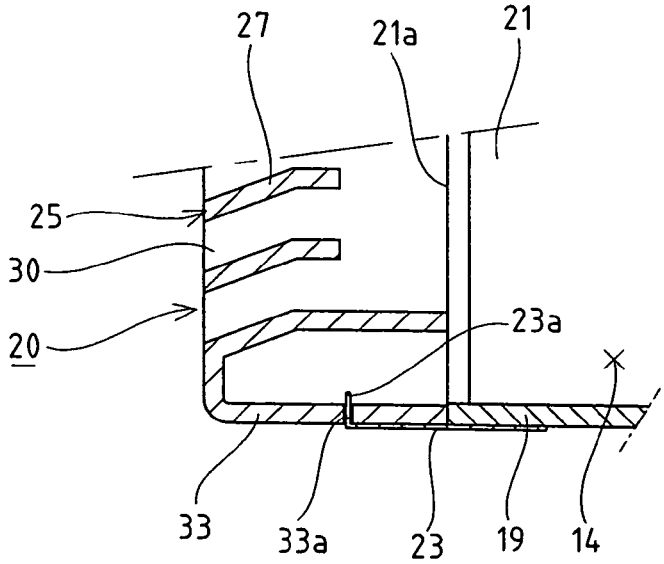
FIG. 5 is a side cross-sectional view of essential portions showing the relationship between the housing and the front panel according to the embodiment.

As shown in FIG. 4, a first guide part 31 inclined in an arc shape so as to be set apart rearward from the inserting/withdrawing opening 28 from the upper end of the first guide part 31 toward the lower end thereof is formed at the left partition 24 and the opposite surface of a left wall 30 of the front panel 20 to the left partition 24. A plurality of second guide parts 32 set apart rearward with a predetermined interval from the rear ends of the slats 27 are formed at a lower position from the corresponding first guide part 31, being apart from each other in the up and down direction at the left partition 24 and the opposite surface of the left wall 30. As shown in FIG. 6, the plurality of second guide parts 32 are structured to be positioned in such a way that they are aligned on an arcuate extension line formed by the first guide part 31, and both widthwise ends of the filter 34 inserted in the inserting/withdrawing opening 28 from the front side are guided downward in abutment by the first guide part 31 and second guide parts 32. The front surface of the recess 29*a* provided at the upper wall 29 faces the arcuate extension line formed by the front surface of the first guide part 31.

An engagement claw 29*b* elastically deformable in the up and down direction is provided on the top surface of the upper wall 29 of the front panel 20 at a position corresponding to each engagement hole 15*c* provided at the front cover member 15 (see FIG. 7). An engagement hole 33*a* is bored through the lower wall 33 of the front panel 20 in the up and down direction at positions corresponding to the engagement pieces 23*a*, 23*a* provided at the housing 11 (see FIG. 5). Further, with the engagement pieces 23*a* of the housing 11 inserted and engaged in the respective engagement holes 33*a* of the front panel 20, each engagement claw 29*b* of the front panel 20 is engaged with the respective engagement hole 15*c* of the front cover member 15, the front panel 20 is positioned and secured to the housing 11 in such a way as to close the opening 11*a* (see FIGS. 4 and 5).

As shown in FIGS. 1 and 2, when the front panel 20 is mounted to the housing 11, a clearance S is formed between the lower surface (bottom plate 15*b*) of the front cover member 15 and the upper surface (upper wall 29) of the front panel 20. The structure is made in such a way that the engagement of the engagement claws 29*b* with the engagement holes 15*c* can be released by inserting a minus driver or the like between the front panel 20 and the front cover member 15 through the clearance S from the front side. The vertical size of the clearance S is set so that fingers cannot enter and the front panel 20 cannot be easily dismounted without using a tool, thus preventing unnecessary accesses to the interior of the machine room.

Figure 8:
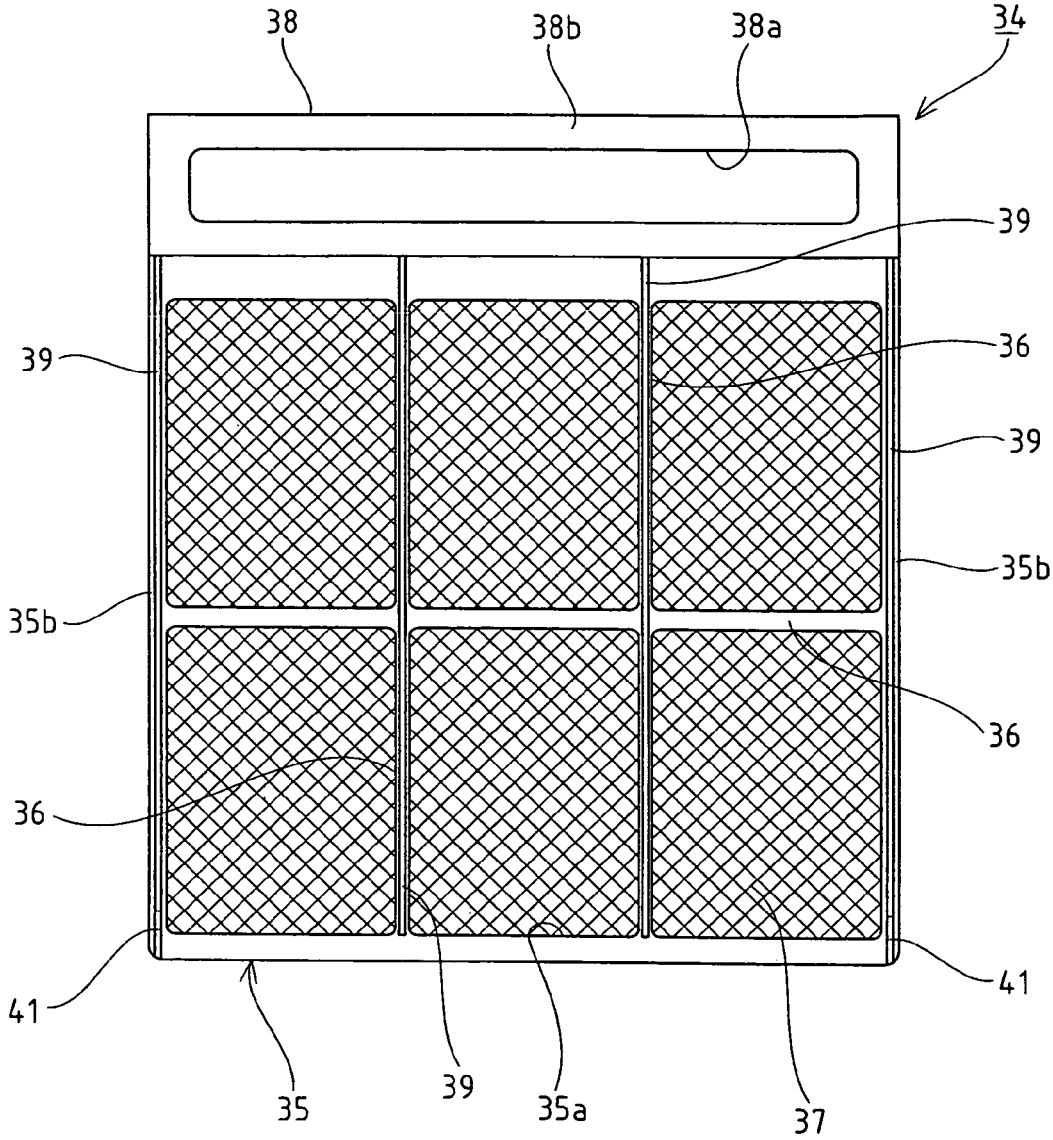
FIG. 8 is a front view of the filter according to the embodiment.
Figure 9:
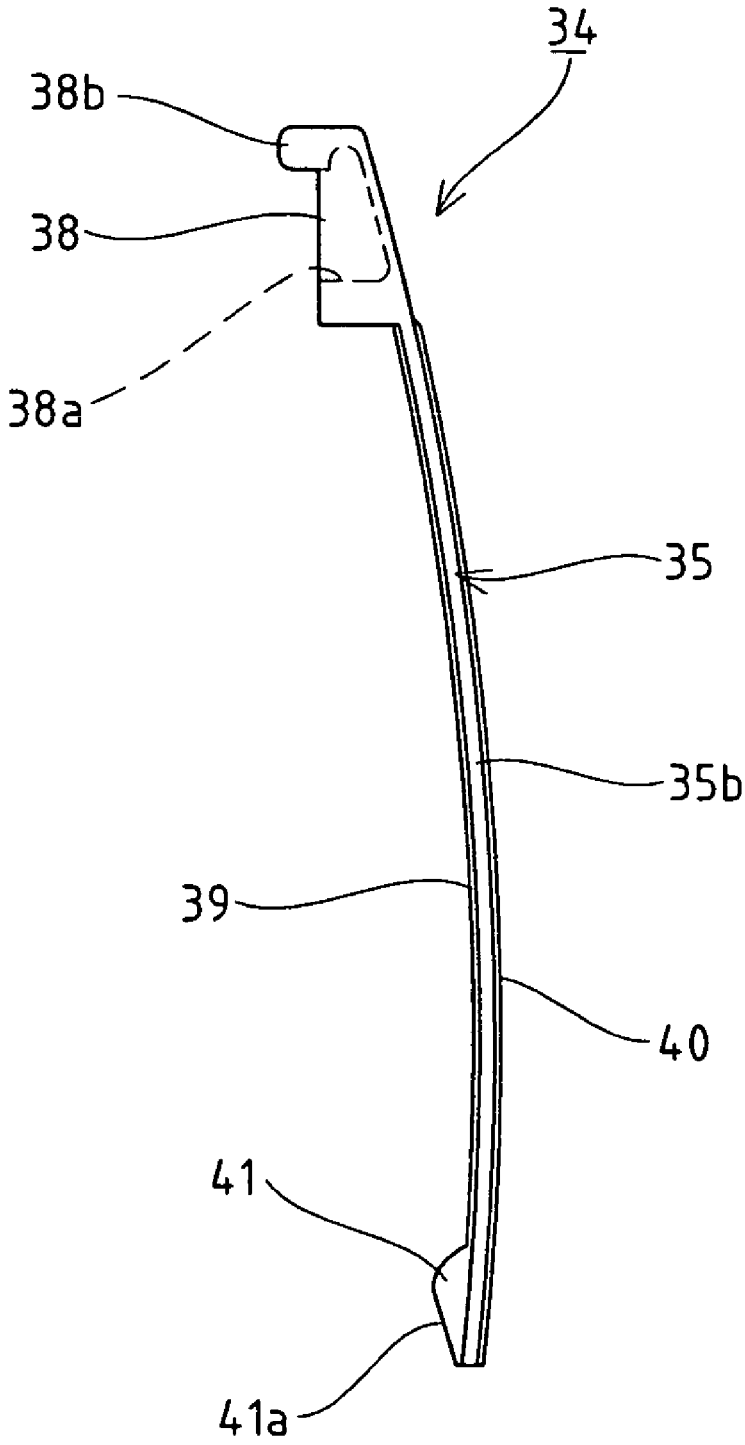
FIG. 9 is a side view of the filter according to the embodiment.

As shown in FIGS. 8 and 9, the filter 34 for collecting dust has a main body 35 of a synthetic resin which is formed into approximately a rectangular shape and is elastically deformable, a rectangular opening 35*a* formed in the main body 35, and shallow members 36, 36 are formed crossing one another to partition the opening 35*a* into a plurality of portions. A mesh member 37 with predetermined meshes is put over the main body 35, covering the entire surface of the opening 35*a*. The width size of the main body 35 is set to be insertable in and detachable from the inserting/withdrawing opening 28 of the front panel 20, and the vertical size of the main body 35 is set in such a way that when the filter 34 is inserted on the rear side of the front panel 20 through the inserting/withdrawing opening 28, the lower end of the main body 35 faces near the lower end of the lower wall 33 to enable removal of dust contained in the air sucked through all the suction louvers 25 (see FIG. 6).

A base portion 38 protruding frontward is formed at a portion of the filter 34 above the forming portion of the opening 35*a* in the main body 35, and a dent portion 38*a* recessed rearward is formed at approximately the vertical center of the base portion 38. The outer size and shape of the base portion 38 are set in such a way that the base portion 38 can be inserted into the inserting/withdrawing opening 28 of the front panel 20 to close the inserting/withdrawing opening 28, and with the main body 35 inserted into the rear side of the front panel 20, as the base portion 38 is fitted into the inserting/withdrawing opening 28, the filter 34 is positioned and held at the front panel 20. With the filter 34 mounted to the front panel 20, the upper end of the base portion 38 faces downward from the top surface of the front panel 20, and the upper portion of the base portion 38 faces the interior of the recess 29*a* formed in the upper wall 29 of the front panel 20. As shown in FIGS. 6 and 9, the main body 35 is curved so that its front side becomes the internal surface side, thus ensuring easy insertion and pull-out of the filter 34 into and from the inserting/withdrawing opening 28. A hand holding part 38*b* to be held by fingers is formed at the widthwise center of the upper front surface of the base portion 38 in such a way as to expand frontward.

As shown in FIGS. 8 and 9, projections 39, 40 extending in the up and down direction are formed at the front and rear surfaces of both left and right frame members 35*b*, 35*b* constituting the main body 35 of the filter 34, and the shallow members 36 extending in the up and down direction. A preventing piece 41 protruding frontward is formed at the lower end portion of the front-side projection 39 formed at each of the left and right frame members 35*b* of the main body 35. As shown in FIGS. 6 and 9, an inclined surface 41*a* inclined from the lower end toward the upper end so as to protrude frontward is formed at the front surface of the preventing piece 41. At the time the filter 34 is inserted into the rear side of the front panel 20, the preventing pieces 41, 41 prevent the lower end portion of the filter 34 from entering the suction port defined by the upper and lower slats 27, 27 of the suction louver 25. The extension length of the inclined surface 41*a* of the preventing piece 41 is set longer than the separate distance between the upper and lower slats 27, 27.

The electric component box 42 accommodating electric components, such as a microcomputer board to control the operation of the cooling mechanism 13 is disposed on the front plate 22 of the housing 11. A power switch 43 and a service switch 44 as operational members for operating the internal electric components are provided at the front surface of the electric component box 42, so that the power switch 43 and the service switch 44 can be operated from the front side. As shown in FIGS. 2 and 4, the layout portions of the power switch 43 and the service switch 44 in the electric component box 42 can be positioned to face the rear side of the inserting/withdrawing opening 28 of the front panel 20 to permit the operation of the power switch 43 and the service switch 44 through the inserting/withdrawing opening 28. When the filter 34 is mounted to the front panel 20, the front sides of the power switch 43 and the service switch 44 are covered with the base portion 38 of the filter 34.

As shown in FIG. 3, an eaves 45 extending frontward and having a predetermined widthwise length is provided at the outer periphery of the upper front surface of the electric component box 42 (above the layout portions of the operational members), and shield parts 46, 46 extending frontward and communicating with the left and right end portions of the eaves 45 are provided at the outer peripheries of the left and right sides of the front surface of the electric component box 42. The eaves 45 and the shield parts 46, 46 prevent dew condensation or the like from entering the layout portions of the power switch 43 and the service switch 44 in the electric component box 42. As shown in FIG. 4, the top surface of the eaves 45 is an upper inclined surface 45*a* inclined upward toward frontward from the front surface of the front plate 22, thereby surely preventing dew condensation or the like falling down to the front surface of the front plate 22 from flowing down to the layout portions of the power switch 43 and the service switch 44. Further, a dewatering part 45*b* suspending from the bottom surface of the eaves 45 is formed at the front end of the eaves 45, so that when dew condensation or the like is adhered to the front surface of the eaves 45, the dew condensation or the like does not reach the layout portion side of the power switch 43 and the service switch 44. The protrusion size of the eaves 45 from the front surface of the electric component box 42 is set larger than the protrusion sizes of the power switch 43 and the service switch 44 from the front surface of the electric component box.

[Operation of Embodiment]

The operation of the ice making machine according to the embodiment will be described below.

First, procedures of mounting and dismounting the front panel 20 and the filter 34 will be described.

As shown in FIG. 3, with the front cover member 15 being disposed at the housing 11, at the time the front panel 20 is mounted to the housing 11, the engagement pieces 23*a* of the support plate 23 disposed on the base plate 19 are inserted into the respective engagement holes 33*a* formed in the lower wall 33 of the front panel 20 (see FIG. 5). Next, as the upper end portion of the front panel 20 is set close to the front surface of the housing 11, the upper wall 29 of the front panel 20 come under the front cover member 15 while the individual engagement claws 29*b* provided at the upper wall 29 are elastically deformed downward. Then, the engagement claws 29*b* are elastically restored to engage with the respective engagement holes 15*c* formed in the bottom plate 15*b* of the front cover member 15 (see FIG. 4), the front panel 20 is mounted to the housing 11 with the opening 11*a* closed (state in FIG. 2). At this time, the power switch 43 and the service switch 44 provided at the front surface of the electric component box 42 face the rear side of the inserting/withdrawing opening 28 provided in the front panel 20.

The filter 34 is inserted in the front panel 20 mounted to the housing 11 from the lower end side of the main body 35 through the inserting/withdrawing opening 28 from the front side of the front panel 20. At this time, the lower ends of both widthwise sides of the filter 34 abut on the first guide parts 31, 31, and are surely guided downward, so that the filter 34 is not inserted in the machine room. The left and right side portions of the filter 34 which is guided downward by the first guide parts 31, 31 are guided to abut on the second guide parts 32, 32, so that the filter 34 is surely inserted to the position covering the entire suction louvers 25 on the rear side of the front panel 20. What is more, as the main body 35 of the filter 34 is curved and elastically deformable, the work of inserting the main body 35 into the rear side of the front panel 20 can be carried out smoothly. Then, as the base portion 38 is fitted in the inserting/withdrawing opening 28 (see FIG. 6), the work of mounting the filter 34 to the front panel 20 is completed (state in FIG. 1).

When the inserting/withdrawing opening 28 is open only frontward, the insertion angle defined by the filter 34 and the front surface of the front cover member 15 needs to be increased at the time the filter 34 is inserted into the inserting/withdrawing opening 28, increasing the resistance at the time the lower ends of the filter 34 abuts on the first guide parts 31 and is guided downward. Because the inserting/withdrawing opening 28 is also open upward through the recess 29*a* formed in the upper wall 29, as shown in FIG. 4, however, it is possible to make the insertion angle of inserting the filter 34 into the inserting/withdrawing opening 28 smaller. This makes it possible to reduce the resistance at the time of insertion and execute smooth insertion. In addition, the front surface of the recess 29*a*, the front surface of the first guide part 31 and the front surface of the second guide parts 32 are positioned approximately on the sane arched extension line as shown in FIG. 6, thereby achieving smoother insertion guide of the filter 34.

In the work of inserting the filter 34 into the front panel 20, the lower end of the filter 34, whose main body 35 is curved so that its front surface becomes the inner peripheral side to facilitate the inserting work, move frontward and thus can enter the suction port between the upper and lower slats 27, 27 during the insertion of the filter 34. In this case, because the preventing pieces 41, 41 are formed at the front surfaces of the lower ends of the left and right sides of the filter 34 in the embodiment, when the filter's lower end moves frontward, the inclined surfaces 41*a*, 41*a* of the preventing pieces 41, 41 abut on the rear ends of the slats 27. As the filter 34 is inserted further in this situation, the lower end of the filter 34 moves rearward while the inclined surfaces 41*a*, 41*a* of the preventing pieces 41, 41 are in abutment on the rear ends of the slats 27. That is, in the work of inserting the filter 34, the preventing pieces 41, 41 prevent the lower end of the filter 34 from entering the suction ports, thus achieving smooth insertion.

As the cooling fan disposed in the machine room 14 is rotated, the outside air is sucked into the machine room 14 through the suction louver 25 and the filter 34. The air is sucked into the condenser 17 from the air suction side to be subjected to heat exchange, is ejected toward the compressor 18 from the cooling fan to be subjected to heat exchange with the compressor 18, and is then discharged outside from the discharge louver 26.

The power switch 43 and the service switch 44 in the electric component box 42 disposed in the machine room 14 have their front sides covered with the base portion 38 of the filter 34, they are not touched by a worker performing a needed work in front of the ice making machine 10 or an object and are not erroneously operated. When the operation of the power switch 43 or the service switch 44 is necessary, pulling the filter 34 out of the inserting/withdrawing opening 28 releases the inserting/withdrawing opening 28 to expose the power switch 43 and the service switch 44 frontward, thus making it possible to easily operate the power switch 43 or the service switch 44 through the inserting/withdrawing opening 28.

That is, in the ice making machine 10 according to the embodiment, the inserting/withdrawing opening 28 for mounting the filter 34 is also used as an opening for operating the power switch 43 and the service switch 44, and the base portion 38 of the filter 34 is used as an open/close door to open/close the operational opening. Therefore, the front panel 20 need not be provided with an exclusive opening and an exclusive open/close door for permitting the operation of the power switch 43 and the service switch 44, thus making it possible to simplify the structure and lower the manufacturing cost.

At the time the power switch 43 or the service switch 44 is operated, or when dust adheres to the filter 34 over time as the condenser 17 is used, causing clogging, or the filter 34 needs to be cleaned or replaced to meet a demand for a predetermined inspection, the filter 34 can be detached from the front panel 20 very easily by holding the hand holding part 38*b* of the filter 34 with fingers and pulling the filter 34 out of the inserting/withdrawing opening 28 obliquely upward. In this case, because the inserting/withdrawing opening 28 is also open upward through the recess 29*a* of the upper wall 29, it is easy to pull the filter 34 out of the inserting/withdrawing opening 28. That is, when the inserting/withdrawing opening 28 is open only frontward, for example, the base portion 38 alone needs to be elastically deformed significantly to pull the base portion 38, fitted in the inserting/withdrawing opening 28, out thereof, so that excessive force is applied to the joint portion of the base portion 38 and the main body 35. Because the inserting/withdrawing opening 28 is also open upward through the recess 29*a* in the embodiment, however, the filter 34 can be pulled out of the inserting/withdrawing opening 28 without causing significant elastic deformation of the base portion 38. Note that because the work of inserting and pulling the filter 34 into and out of the front panel 20 is easy as mentioned above, the work of removing the filter 34 which is needed to operate the power switch 43 or the service switch 44 is not troublesome.

Dew condensation produced on the front surface of the front cover member 15 by the operation of the ice making machine 10 falls down to the lower end of the front cover member 15, reaches the front plate 22 of the housing 11 along the bottom surface, and then flows down to the layout position of the electric component box 42. Further, dew condensation produced directly on the front plate 22 also flows down to the layout position of the electric component box 42. In this case, as shown in FIG. 4, since the eaves 45 extending frontward is provided above the layout portions of the power switch 43 and the service switch 44, the eaves 45 can prevent the dew condensation flowing down along the front surface of the front plate 22 from reaching the layout portions of the power switch 43 and the service switch 44. That is, it is possible to prevent dew condensation from entering the electric component box through the layout portions of the power switch 43 and the service switch 44, thereby preventing occurrence of corrosion of the internal electric components or electric leakage and so forth. Further, as the top surface of the eaves 45 is inclined upward, dew condensation having reached the upper inclined surface 45*a* of the eaves 45 does not flow frontward to reach the layout portions of the power switch 43 and the service switch 44 from the front surface side. In addition, the dewatering part 45*b* is formed at the front end of the eaves 45, so that if dew condensation adheres to the front surface of the eaves 45, dew condensation having flowed down to the lower end of the dewatering part 45*b* does not reach the layout portions of the power switch 43 and the service switch 44 along the bottom surface of the eaves 45.

It is to be noted that to dismount the front panel 20 from the housing 11 at the time of performing maintenance of the cooling mechanism 13 or the like disposed in the machine room 14, a tool like a minus driver is inserted between the front panel 20 and the front cover member 15 through the clearance S to disengage the engagement claws 29*b* from the respective engagement holes 15*c*. Then, the upper portion of the front panel 20 is inclined until it comes frontward of the front cover member 15, after which the front panel 20 is lifted up to pull the engagement pieces 23*a* of the support plate 23 out of the engagement holes 33*a* of the lower wall 33. As a result, the front panel 20 can be dismounted from the housing 11, releasing the opening 11*a*. The embodiment is structured in such a way that in this case, the mounting/dismounting of the front panel 20 to/from the housing 11 can be done without using fixing means, such as a screw. It is to be noted however that as the vertical size of the clearance S is set so that fingers do not enter the clearance S, the front panel 20 cannot be dismounted unless a tool which can be inserted into the clearance S is used, thus suppressing unnecessary accesses to the interior of the machine room.

[Modifications]

The present application is not limited to the structure of the foregoing embodiment, and other structures can be adopted as needed.

1. Although the power switch and service switch are mentioned as operational members to be disposed in the electric component box in the embodiment, which are not restrictive, and may be a setting dial, a fuse or the like for setting various other conditions, such as the ice making time and the number of cycles to entirely discharge ice making water.

2. Although the description of the embodiment has been given of the case where the suction louver as the suction part and the discharge louver as a discharge part are provided in line at the front panel, only the suction part needs to be provided at the front panel, while the discharge part may be provided at the side plate, the rear plate, the base plate or the like of the housing or at any other portion.

3. While a louver is employed as an outside air suction part in the embodiment, a plurality of through holes may be formed instead.

4. While preventing pieces are provided on both left and right sides of the film in the embodiment, the number of the preventing pieces provided and the layout positions thereof are not limited to those of the embodiment, the preventing pieces may be provided at the lower frame members constituting the main body and extending horizontally.

5. Although the foregoing description of the embodiment has been given of a device having a machine room defined on the lower side of the housing, the embodiment is applicable to a device having the machine room defined on the upper side of the housing.

The invention claimed is:

1. A device equipped with a cooling mechanism (13) including a condenser (17) or the like disposed in a machine room (14) defined inside a housing (11), and a suction part (25) provided at a front panel (20) sealing an opening (11*a*) formed in a front portion of the housing (11) which corresponds to the machine room (14) so that outside air sucked into the machine room (14) through the suction part (25) contacts the condenser (17) for heat exchange, characterized in that an electric component box (42) accommodating an electric part for controlling the cooling mechanism (13) is disposed in the machine room (14) in such a way that an operational member (43, 44) provided at a front surface of the electric component box (42) faces a rear side of a filter inserting/withdrawing opening (28) formed in the front panel (20) at a portion upper than a forming location of the suction part (25) and penetrating in a to-and-fro direction, and a base portion (38) closing the filter inserting/withdrawing opening (28) to cover a front side of the operational member (43, 44) of the electric component box (42) is provided at a filter (84) insertable in and withdrawable from the filter inserting/withdrawing opening (28) and covering a rear side of the suction part (25) when inserted from front side of the front panel (20) through the filter inserting/withdrawing opening (28) rearward from the front panel (20).

2. The device according to claim 1, wherein an eaves (45) extending frontward is provided at the front side of the electric component box (42) in a predetermined length in a widthwise direction and above the operational member (43, 44), and an upper surface (45*a*) of the eaves (45) is inclined upward in a frontward direction of the upper surface (45*a*).

3. The device according to claim 1, wherein a recess (29*a*) having substantially the same width as that of the inserting/withdrawing opening (28), recessed rearward, and open upward, downward and frontward is provided at a front portion of an upper wall (29) of the front panel (20).

4. The device according to claim 1, wherein the filter (34) is formed in an arcuate shape with a front side being an inner peripheral side, and a preventing piece (41) protruding in such a way as to be inclined frontward in an upward direction from a lower end of the front side of the filter (34) is provided at the lower end of the front side of the filter (34).

* * * * *